US009417646B2

(12) United States Patent
Yasusaka

(10) Patent No.: US 9,417,646 B2
(45) Date of Patent: Aug. 16, 2016

(54) POWER SUPPLY CIRCUIT

(71) Applicant: Rohm Co., Ltd., Kyoto (JP)

(72) Inventor: Makoto Yasusaka, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 74 days.

(21) Appl. No.: 14/327,624

(22) Filed: Jul. 10, 2014

(65) Prior Publication Data

US 2015/0015224 A1 Jan. 15, 2015

(30) Foreign Application Priority Data

Jul. 11, 2013 (JP) ..... 2013-145715

(51) Int. Cl.
*G05F 1/565* (2006.01)
*G05F 1/575* (2006.01)
*H02M 3/156* (2006.01)

(52) U.S. Cl.
CPC ..... *G05F 1/575* (2013.01)

(58) Field of Classification Search
CPC ..... H02M 2001/0025; H02M 3/156; G05F 1/56; G05F 1/565
USPC ..... 323/299, 303, 274, 284
See application file for complete search history.

(56) References Cited

U.S. PATENT DOCUMENTS 6,281,667 B1 * 8/2001 Matsumura ..... G05F 1/565 323/274
7,218,086 B1 * 5/2007 Ritter ..... H05B 33/0815 323/284
9,013,166 B2 * 4/2015 Lee ..... H02M 3/156 323/285

FOREIGN PATENT DOCUMENTS

JP 2007-179345 7/2007

* cited by examiner

*Primary Examiner* — Gary L Laxton
(74) *Attorney, Agent, or Firm* — Fish & Richardson P.C.

(57) ABSTRACT

A power supply circuit includes a transistor disposed between an input terminal to which an input voltage is applied and an output terminal to which an output voltage is applied, and an error amplifier configured to compare a feedback voltage varied based on the output voltage and a reference voltage, and control the transistor based on a result of the comparison, the reference voltage being generated by selectively using the input voltage or the output voltage.

17 Claims, 11 Drawing Sheets

POWER SUPPLY CIRCUIT

CROSS-REFERENCE TO RELATED APPLICATIONS

This application is based upon and claims the benefit of priority from Japan Patent Application No. 2013-145715, filed on Jul. 11, 2013, the entire contents of which are incorporated herein by reference.

TECHNICAL FIELD

The present disclosure relates to a power supply circuit.

BACKGROUND

FIG. 11 shows a diagram of a related power supply circuit 901 for use in a series regulator. The power supply circuit 901 may be used in an LDO (Low Drop Out) regulator or the like. The power supply circuit 901 includes an output transistor 913 connected between an input terminal 911 to which an input voltage $V_{in}$ is applied and an output terminal 912 from which an output voltage $V_o$ is output. An error amplifier 914 may control the output transistor 913 based on a predetermined reference voltage $V_{ref}$ and a feedback voltage $V_{fb}$ which may be varied based on the output voltage $V_o$. A reference voltage generating circuit 915 may generate the reference voltage $V_{ref}$ based on the input voltage $V_{in}$.

The reference voltage generating circuit 915 may be configured to generate a constant voltage. However, if the input voltage $V_{in}$ as a drive voltage is varied, the reference voltage $V_{ref}$ may also be varied to some extent due to the variation of the input voltage $V_{in}$, which may result in an undesired variation of the output voltage $V_o$ (see FIG. 12). As such, the variation of the input voltage $V_{in}$ may deteriorate characteristics of the power supply circuit 901 of FIG. 11.

SUMMARY

The present disclosure provides some embodiments of a power supply circuit which is capable of contributing to improvement of characteristics.

According to one embodiment of the present disclosure, there is provided a power supply circuit including a transistor disposed between an input terminal to which an input voltage is applied and an output terminal to which an output voltage is applied, and an error amplifier configured to compare a feedback voltage varied based on the output voltage and a reference voltage, and control the transistor based on a result of the comparison, the reference voltage being generated by selectively using the input voltage or the output voltage.

In one embodiment, the reference voltage may be generated based on the input voltage if the output voltage is smaller than a predetermined value, and the reference voltage may be generated based on the output voltage if the output voltage is greater than the predetermined value.

In one embodiment, the power supply circuit may further include a first voltage generating circuit configured to generate and output a first voltage based on the input voltage, and a second voltage generating circuit configured to generate and output a second voltage based on the output voltage if the output voltage is greater than the predetermined value, the second voltage being greater than the first voltage, wherein the error amplifier may be configured to include first and second input terminals for receiving the first and second voltages, respectively, and control the transistor using a greater voltage of the received first and second voltages as the reference voltage.

In one embodiment, the power supply circuit may further include a first voltage generating circuit configured to generate a first voltage based on the input voltage, a second voltage generating circuit configured to generate a second voltage based on the output voltage, a changeover switch configured to selectively provide the error amplifier with the first voltage or the second voltage as the reference voltage, and a switch control circuit configured to control the changeover switch based on the output voltage.

In one embodiment, the power supply circuit may further include a reference voltage generating circuit configured to generate the reference voltage based on a voltage applied to a feed terminal, a changeover switch configured to selectively provide the feed terminal with the input voltage or the output voltage, and a switch control circuit configured to control the changeover switch based on the output voltage.

In one embodiment, the power supply circuit may further include a reference voltage generating circuit configured to generate the reference voltage based on a voltage applied to a feed terminal, a first diode unit, which is interposed between the input terminal and the feed terminal, configured to include one or more first diodes, a forward bias direction of each of the first diodes being a direction from the input terminal to the feed terminal, and a second diode unit, which is interposed between the output terminal and the feed terminal, configured to include one or more second diodes, a forward bias direction of each of the second diodes being a direction from the output terminal to the feed terminal, wherein a voltage associated with the input voltage via the first diode unit or a voltage associated with the output voltage via the second diode unit is supplied to the feed terminal based on the output voltage.

In one embodiment, the power supply circuit may be configured as a series regulator.

In one embodiment, the power supply circuit may be configured as a switching regulator.

According to another embodiment of the present disclosure, there is provided a semiconductor device including an integrated circuit for configuring the above-described power supply circuit.

According to another embodiment of the present disclosure, there is provided an electronic apparatus including the above-described semiconductor device.

According to another embodiment of the present disclosure, there is provided a power supply circuit including an input terminal to which an input voltage is applied, an output terminal to which an output voltage is applied, an output transistor configured to generate the output voltage via the output terminal by switching the input voltage, and an error amplifier configured to compare a feedback voltage varied based on the output voltage and a reference voltage, and control the output transistor based on a result of the comparison, the reference voltage being generated by selectively using the input voltage or the output voltage.

In one embodiment, the reference voltage may be generated based on the input voltage if the output voltage is smaller than a predetermined value, and the reference voltage is generated based on the output voltage if the output voltage is greater than the predetermined value.

In one embodiment, the power supply circuit may further include a first voltage generating circuit configured to generate and output a first voltage based on the input voltage, and a second voltage generating circuit configured to generate and output a second voltage based on the output voltage if the output voltage is greater than the predetermined value, the second voltage being greater than the first voltage, wherein the error amplifier is configured to include first and second input terminals for receiving the first and second voltages, respectively, and control the output transistor using a greater voltage of the received first and second voltages as the reference voltage.

In one embodiment, the power supply circuit may further include a first voltage generating circuit configured to generate a first voltage based on the input voltage, a second voltage generating circuit configured to generate a second voltage based on the output voltage, a changeover switch configured to selectively provide the error amplifier with the first voltage or the second voltage as the reference voltage, and a switch control circuit configured to control the changeover switch based on the output voltage.

In one embodiment, the power supply circuit may further include a reference voltage generating circuit configured to generate the reference voltage based on a voltage applied to a feed terminal, a changeover switch configured to selectively provide the feed terminal with the input voltage or the output voltage, and a switch control circuit configured to control the changeover switch based on the output voltage.

In one embodiment, the power supply circuit may further include a reference voltage generating circuit configured to generate the reference voltage based on a voltage applied to a feed terminal, a first diode unit, which is interposed between the input terminal and the feed terminal, configured to include one or more first diodes, a forward bias direction of each of the first diodes being a direction from the input terminal to the feed terminal, and a second diode unit, which is interposed between the output terminal and the feed terminal, configured to include one or more second diodes, a forward bias direction of each of the second diodes being a direction from the output terminal to the feed terminal, wherein a voltage associated with the input voltage via the first diode unit or a voltage associated with the output voltage via the second diode unit is supplied to the feed terminal based on the output voltage.

In one embodiment, the power supply circuit may be configured as a switching regulator.

According to another embodiment of the present disclosure, there is provided a semiconductor device including an integrated circuit for configuring the above-described power supply circuit.

According to another embodiment of the present disclosure, there is provided an electronic apparatus including the above-described semiconductor device.

DETAILED DESCRIPTION

Figure 1A:
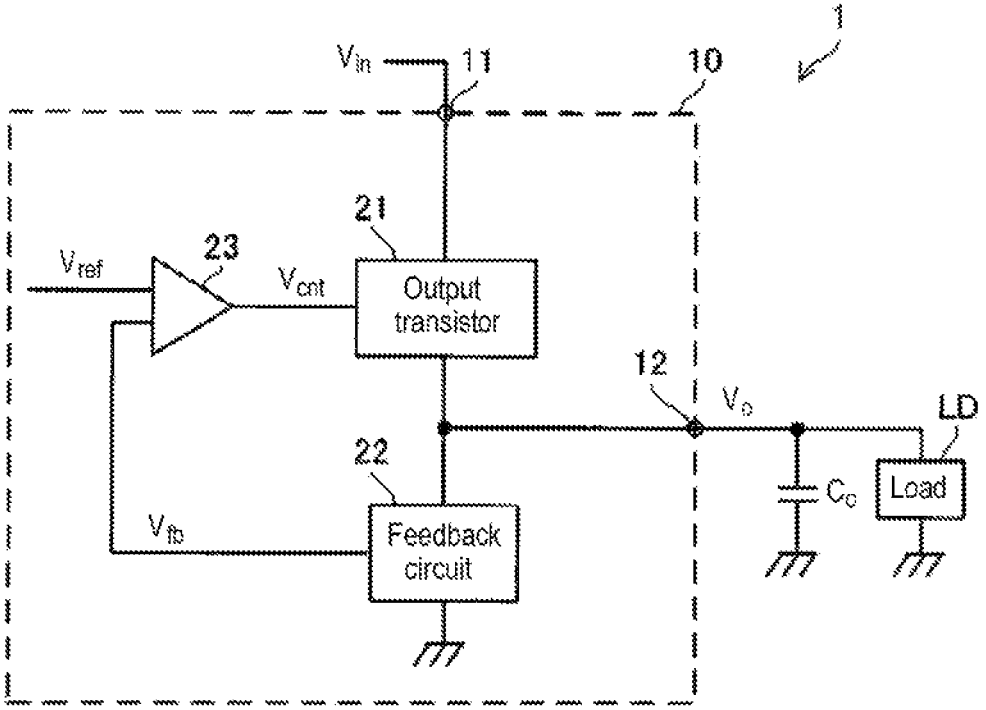
FIG. 1A schematically illustrates a configuration of a power supply circuit according to a first embodiment of the present disclosure.

Some embodiments of the present disclosure will now be described in detail with reference to the drawings. Throughout the drawings, the same elements are denoted by the same reference numerals and explanation of which will not be repeated. In the specification, for the purpose of brevity of description, symbols or signs referring to information, signals, physical quantities, state quantities, members and so on may be used to omit or shorten names of information, signals, physical quantities, state quantities, members and so on corresponding to the symbols or signs.

First Embodiment

FIG. 1A schematically illustrates a configuration of a power supply circuit 1 according to a first embodiment of the present disclosure. Based on a DC input voltage $V_{in}$, the power supply circuit 1 may generate a DC output voltage $V_o$ which is different from the input voltage $V_{in}$. The power supply circuit 1 includes a power supply IC 10 which is a semiconductor integrated circuit. In one embodiment, the power supply IC 10 alone may be referred to as the power supply circuit 1. The power supply circuit 1 may be used in a series regulator such as an LDO regulator. As illustrated, the power supply IC 10 may include an input terminal 11 to which the input voltage $V_{in}$ is applied and an output terminal 12 to which the output voltage $V_o$ is applied. Further, the power supply IC 10 may include an output transistor 21, a feedback circuit 22, and an error amplifier 23.

An output capacitor $C_o$ is connected to the output terminal 12. Further, a load LD is also connected to the output terminal 12. Voltage potentials such as the input voltage $V_{in}$ and the output voltage $V_o$ may be measured with respect to a specified voltage potential which is referred to as a reference voltage potential. In addition, a wiring, a metal layer, or a metal point having the reference voltage potential may be referred to as ground (or reference potential line). The reference potential is 0 volt (V). In this embodiment, the input voltage $V_{in}$ and the output voltage $V_o$ may be set to be positive. In this configuration, an anode of the output capacitor $C_o$ is connected to the output terminal 12 and a cathode of the output capacitor $C_o$ is connected to the ground.

The output transistor 21, interposed between the input terminal 11 and the output terminal 12, may adjust a current flowing between the input terminal 11 and the output terminal 12 such that the output voltage $V_o$ is maintained at a predetermined target voltage $V_{tg}$. For example, the output transistor 21 may be a field effect transistor such as a MOSFET (Metal-Oxide-Semiconductor Field-Effect Transistor) or a JFET (Junction Field-Effect Transistor), or a bipolar transistor. Although FIG. 1A describes that the output transistor 21 is interposed between the input terminal 11 and the output terminal 12, one or more circuit elements other than the output transistor 21 may be interposed between the input terminal 11 and the output terminal 12. If the power supply circuit 1 is used in a switching regulator, the output transistor 21 may not exist between the input terminal 11 and the output terminal 12.

The feedback circuit 22, which is connected to the output terminal 12, generates and outputs a feedback voltage $V_{fb}$ varied based on the output voltage $V_o$. The feedback voltage $V_{fb}$ may be equal to the output voltage $V_o$.

The error amplifier 23, which is configured to receive the reference voltage $V_{ref}$ and the feedback voltage $V_{fb}$ as inputs, generates and outputs a control voltage $V_{cnt}$ so as to make a difference therebetween (i.e., $V_{ref}-V_{fb}$) close to zero, and thus, maintain the output voltage $V_o$ at the predetermined target voltage $V_{tg}$. In one embodiment, maintaining the output voltage $V_o$ at the target voltage $V_{tg}$ may include adjusting the output voltage $V_o$ close to the target voltage $V_{tg}$. The error amplifier 23 may be operated with the input voltage $V_{in}$. If the power supply circuit 1 is used in a series regulator, the control voltage $V_{cnt}$ may be supplied to a control terminal of the output transistor 21. If the output transistor 21 is a field effect transistor, the control terminal may be a gate and the control voltage $V_{cnt}$ of the output transistor 21 may be a gate voltage of the output transistor 21. If the output transistor 21 is a bipolar transistor, the control terminal may be a base and the control voltage $V_{cnt}$ of the output transistor 21 may be a base voltage of the output transistor 21, respectively.

However, a DC component of the input voltage $V_{in}$ may be varied within a predetermined voltage range. For example, an electronic apparatus (such as a notebook computer or a personal computer) driven by a battery or an AC adaptor may include the power supply circuit 1 in which an output voltage of the battery and an output voltage of the AC adaptor may be selectively used as the input voltage $V_{in}$. In this case, the DC component of the input voltage $V_{in}$ may be, for example, either 7V or 19V. A characteristic indicating the variation of the DC component in the output voltage $V_o$ with respect to the variation of the DC component in the input voltage $V_{in}$ may be defined by the line regulation (also referred to as a power supply variation rate). The input voltage $V_{in}$ may vary around a voltage value of the DC component of the input voltage $V_{in}$ at relatively high frequencies. The variation of the input voltage $V_{in}$ at the relatively high frequencies may be referred to as a power supply ripple. Further, a characteristic related with suppression of the power supply ripple may be defined by PSRR (Power Supply Ripple Rejection). Improvement of the line regulation and PSSR characteristics may be beneficial in many cases.

A power supply circuit in the related art may generate a reference voltage directly from an input voltage. In this case, however, the variation of the input voltage causes the variation of the reference voltage which in turn may negatively affect an output voltage. For example, characteristics such as the line regulation, the PSRR, the output noise and so on may deteriorate.

Figure 1B:
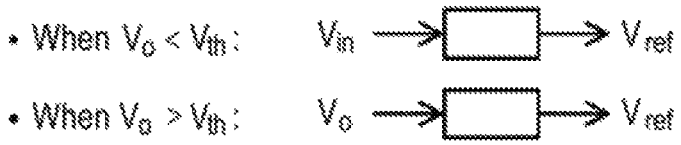
FIG. 1B illustrates a source voltage of a reference voltage according to the first embodiment of the present disclosure.

In this embodiment, the error amplifier 23 of the power supply circuit 1 may compare the feedback voltage $V_{fb}$ with the reference voltage $V_{ref}$ which is generated by selectively using the input voltage $V_{in}$ or the output voltage $V_o$, generate and output the control voltage $V_{cnt}$ based on the result of the above comparison, and control the output transistor 21 by using the control voltage $V_{cnt}$. When the output voltage $V_o$ is not increased to a preset level, for example, during a start-up stage of the power supply circuit 1, it is difficult to generate the reference voltage $V_{ref}$ from the output voltage $V_o$. Therefore, as shown in FIG. 1B, the reference voltage $V_{ref}$ may be generated based on the input voltage $V_{in}$ if the output voltage $V_o$ is smaller than a predetermined threshold voltage $V_{th}$. On the other hand, the reference voltage $V_{ref}$ may be generated based on the output voltage $V_o$ if the output voltage $V_o$ is greater than the predetermined threshold voltage $V_{th}$. In this configuration, the threshold voltage $V_{th}$ may be a positive voltage value but, smaller than the target voltage $V_{tg}$ (that is, $0<V_{th}<V_{tg}$). If the output voltage $V_o$ is equal to the threshold voltage $V_{th}$, the reference voltage $V_{ref}$ may be generated based on either the input voltage $V_{in}$ or the output voltage $V_o$. In the following description, it is assumed that the reference voltage $V_{ref}$ is generated based on the output voltage $V_o$ when the output voltage $V_o$ is equal to the threshold voltage $V_{th}$. As used herein, a certain voltage such as the input voltage $V_{in}$, the output voltage $V_o$, or the like may refer to a value of the certain voltage. Further, a magnitude of a certain voltage may refer to an absolute value of the certain voltage. As the output voltage $V_o$ is assumed to be positive, the magnitude of the output voltage $V_o$ may be equal to the value of the output voltage $V_o$.

The input voltage referring to the value of the input voltage $V_{in}$ may be denoted as "$V_{in}$." This may be similarly applied to other voltages such as $V_o$, $V_{th}$, and so on, which contain the alphabet "V."

Figure 2:
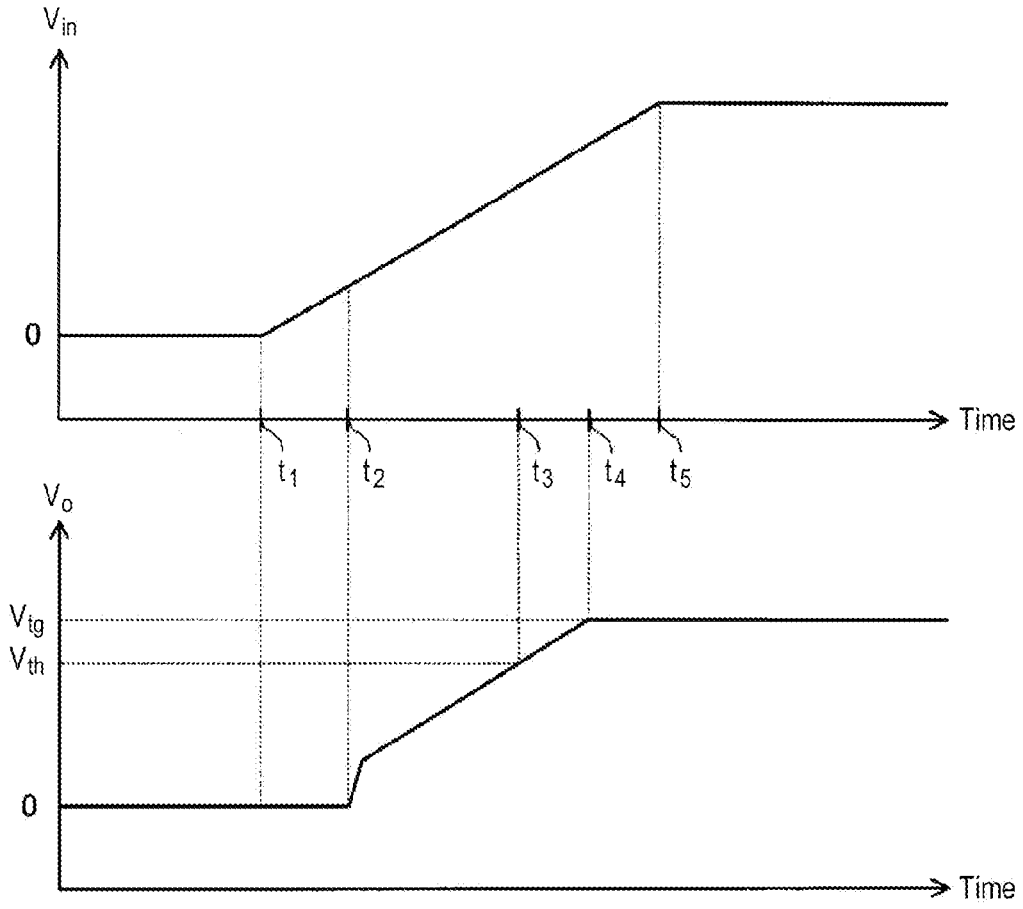
FIG. 2 schematically shows changes in input and output voltages at a start-up stage of the power supply circuit, according to the first embodiment of the present disclosure.

FIG. 2 schematically shows changes in the input voltage $V_{in}$ and the output voltage $V_o$. As shown in FIG. 2, as the time progresses, time points $t_1$, $t_2$, $t_3$, $t_4$, and $t_5$ may elapse in that order. Before the time point $t_1$, both the input voltage $V_{in}$ and the output voltage $V_o$ equal to 0 volt (V). After the time point $t_1$, the input voltage $V_{in}$ increases from 0V to a specified value over a time period from the time point $t_1$ to the time point $t_5$. During the time period after the time point $t_1$, including the time point $t_2$, the input voltage $V_{in}$ is greater than 0V, but between the time points $t_1$ and $t_2$, a control system including the error amplifier 23 has not yet started and the output voltage $V_o$ remains at 0V. As the control system is started at the time point $t_2$ and the output voltage $V_o$ may start to increase from 0V at the time point $t_2$ and reach (i.e., becomes equal to) the threshold voltage $V_{th}$ at the time point $t_3$. Thereafter, the output voltage $V_o$ continues to rise to reach the target voltage $Vt_g$ at the time point $t_4$ and remains at the target voltage $V_{tg}$. In addition, a time point at which the output voltage $V_o$ reaches the target voltage $V_{tg}$ may be varied based on conditions such as the capacity of the output capacitor $C_o$.

During a time period from the time point $t_2$ to the time point $t_3$, since the output voltage $V_o$ is smaller than the threshold voltage $V_{th}$, the reference voltage $V_{ref}$ may be generated based on the input voltage $V_{in}$ and input to the error amplifier 23. After the time point $t_3$, since the output $V_o$ is greater than the threshold voltage $V_{th}$, the reference voltage $V_{ref}$ may be generated based on the output voltage $V_o$ and input to the error amplifier 23.

In the power supply circuit 1, the reference voltage $V_{ref}$ may be generated from the output voltage $V_o$ in a steady state. Therefore, the variation of the reference voltage $V_{ref}$ due to the variation of the input voltage $V_{in}$ in the steady state is eliminated, thereby improving the characteristics of the power supply circuit 1 (such as improved line regulation and PSRR, reduction of output noise, and so on). An LDO regulator may output a constant voltage with less noise. Therefore, when the power supply circuit 1 is used in the LDO regulator, the reference voltage $V_{ref}$ may be stable by using an output voltage of the LDO regulator in generating the reference voltage $V_{ref}$. Further, the LDO regulator that operates with the reference voltage $V_{ref}$ may also generate a more stable output voltage. In addition, since no negative feedback circuit is formed in generating the reference voltage $V_{ref}$ based on the output voltage $V_o$, the reference voltage $V_{ref}$ may not oscillate.

Second Embodiment

A second embodiment of the present disclosure will now be described. The second embodiment and subsequent third to eighth embodiments are based on the first embodiment and the description on the first embodiment may be applied to the second to eighth embodiments unless otherwise stated and inconsistent. Unless inconsistent, combinations of all or some of the first to eighth embodiments may be made.

Figure 3:
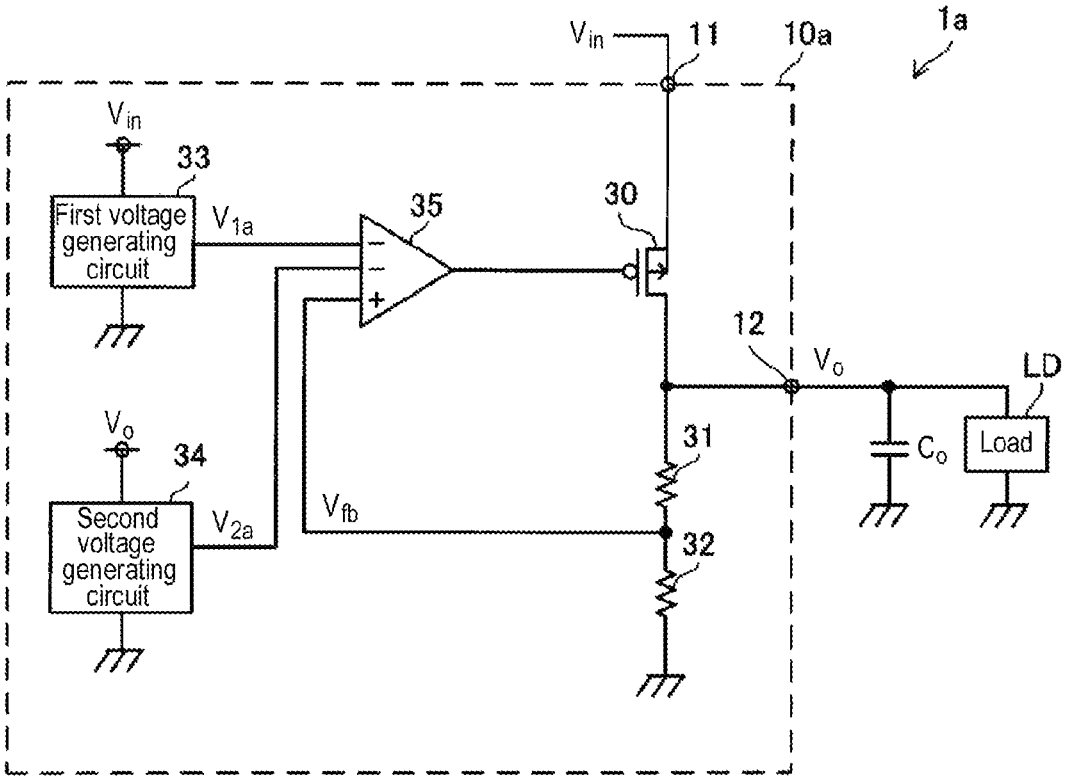
FIG. 3 illustrates a configuration of a power supply circuit according to a second embodiment of the present disclosure.

FIG. 3 illustrates a configuration of a power supply circuit 1*a* and a power supply IC 10*a* according to the second embodiment of the present disclosure. The power supply circuit 1*a* and the power supply IC 10*a* may be examples of the power supply circuit 1 and the power supply IC 10 of FIG. 1A, respectively. In the power supply circuit 1*a*, the power supply IC 10*a* is provided with the input terminal 11 and the output terminal 12 while the output capacitor $C_o$ and the load LD are connected to the output terminal 12 similar to the power supply circuit 1. The power supply IC 10*a* also includes an output transistor 30, voltage dividing resistors 31 and 32, first and second voltage generating circuits 33 and 34, and an error amplifier 35. The output transistor 30, a series circuit of the voltage dividing resistors 31 and 32, and the error amplifier 35 may be examples of the output transistor 21, the feedback circuit 22 and the error amplifier 23 of FIG. 1A, respectively.

The output transistor 30 may be a P-channel MOSFET and hereinafter referred to as a FET 30. A source of the FET 30 is connected to the input terminal 11 where the input voltage $V_{in}$ is applied. A drain of the FET 30 is connected to the output terminal 12 and is also connected to the ground via the series circuit of the voltage dividing resistors 31 and 32. More specifically, the drain of the FET 30 is connected to one end of the voltage dividing resistor 31 and the other end of the voltage dividing resistor 31 is connected to the ground via the voltage dividing resistor 32. A voltage of a node between the voltage dividing resistors 31 and 32 (i.e., a voltage obtained by dividing the output voltage $V_o$ with a ratio depending on resistances of the resistors 31 and 32) is input, as the feedback voltage $V_{fb}$, to a non-inverted input terminal of the error amplifier 35.

The first voltage generating circuit (or a first reference voltage generating circuit) 33 generates and outputs a predetermined positive voltage (or a first reference voltage) $V_{1a}$ based on a voltage applied to the input terminal 11 (i.e., the input voltage $V_{in}$). In the following description, it is assumed that the input voltage $V_{in}$ is greater than 0V such that the positive voltage $V_{1a}$ may be generated.

The second voltage generating circuit (or a second reference voltage generating circuit) 34 generates and outputs a predetermined positive voltage (or a second reference voltage) $V_{2a}$ based on a voltage applied to the output terminal 12 (i.e., the output voltage $V_o$). Here, the voltage $V_{2a}$ is greater than the voltage $V_{1a}$. If the output voltage $V_o$ is smaller than a threshold voltage $V_{th}$, the second voltage generating circuit 34 may not be started and thus may neither generate nor output the voltage $V_{2a}$ which is greater than the voltage $V_{1a}$. On the contrary, if the output voltage $V_o$ is equal to or greater than the threshold voltage $V_{th}$, the second voltage generating circuit 34 may be started and thus generate and output the voltage $V_{2a}$ which is greater than the voltage $V_{1a}$. If the output voltage $V_o$ is smaller than the threshold voltage $V_{th}$, the output voltage $V_{2a}$ of the second voltage generating circuit 34 is smaller than the output voltage $V_{1a}$ of the first voltage generating circuit 33 or may be zero.

The error amplifier 35 has first and second inverted input terminals to which the output voltage $V_{1a}$ of the first voltage generating circuit 33 and the output voltage $V_{2a}$ of the second voltage generating circuit 34 are respectively input. The error amplifier 35 uses a greater voltage of the voltages $V_{1a}$ and $V_{2a}$ input to the first and second inverted input terminals as the reference voltage $V_{ref}$ and controls the FET 30 based on the reference voltage $V_{ref}$ and the feedback voltage $V_{fb}$. The FET 30 may be controlled by varying the gate voltage of the FET 30 (i.e., a voltage potential of the gate of the FET 30). The gate voltage of the FET 30 is an example of the control voltage $V_{cnt}$ as shown in FIG. 1A.

In the power supply circuit 1*a*, the voltage $V_{1a}$ is used as the reference voltage $V_{ref}$ during a time period in which the output voltage $V_o$ is smaller than the threshold voltage $V_{th}$, and the error amplifier 35 and the FET 30 are controlled based on the voltage $V_{1a}$. On the other hand, during a time period in which the output voltage $V_o$ is equal to or greater than the threshold voltage $V_{th}$, the voltage $V_{2a}$ is used as the reference voltage $V_{ref}$, and the error amplifier 35 and the FET 30 are controlled based on the voltage $V_{2a}$. With the above configurations, the characteristics of the power supply circuit described in the first embodiment may be improved.

When the voltage $V_{2a}$ is used as the reference voltage $V_{ref}$, the voltage $V_{2a}$ and the resistances of the voltage dividing resistors 31 and 32 may be determined such that the output voltage $V_o$ reaches and remains at the target voltage $V_{tg}$. When the voltage $V_{1a}$ is used as the reference voltage $V_{ref}$, the output voltage $V_o$ is smaller than the target voltage $V_{tg}$. When the voltage $V_{1a}$ is used as the reference voltage $V_{ref}$, the voltage $V_{1a}$ may be set and the second voltage generating circuit 34 may be designed so that the voltage $V_{2a}$ may be generated from the output voltage $V_o$.

Third Embodiment

Figure 4:
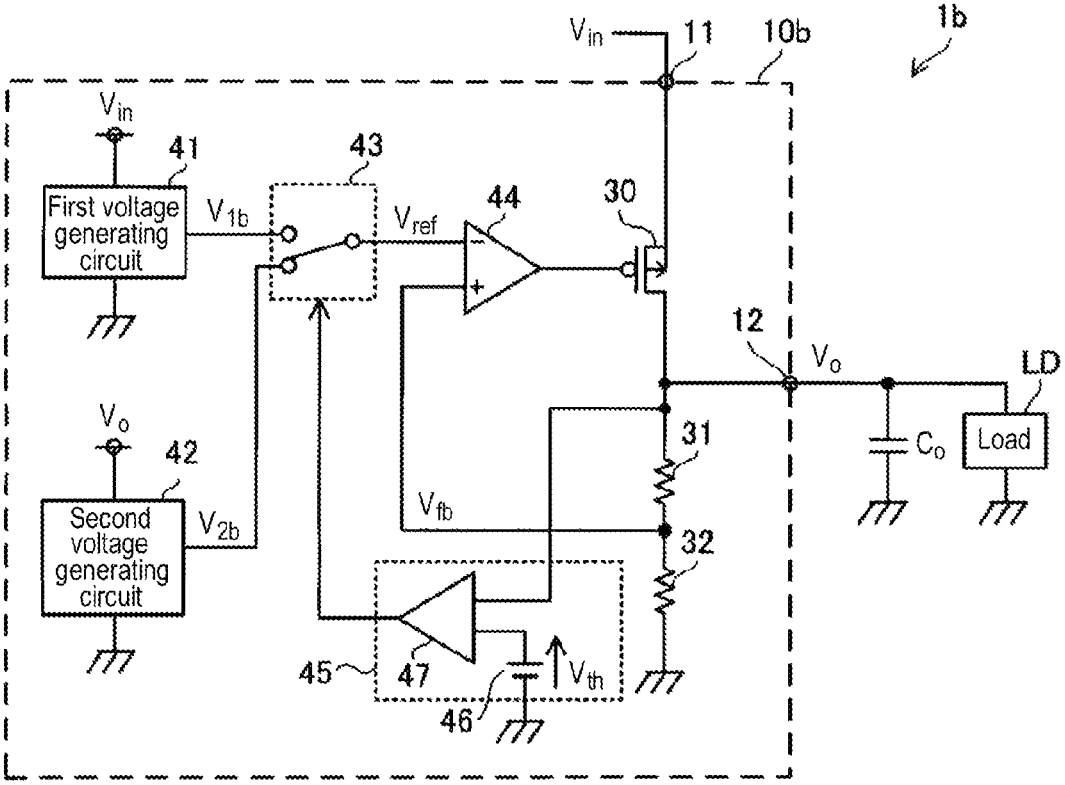
FIG. 4 shows a configuration of a power supply circuit according to a third embodiment of the present disclosure.

A third embodiment of the present disclosure will now be described. FIG. 4 shows a configuration of a power supply circuit 1*b* and a power supply IC 10*b* according to the third embodiment of the present disclosure. The power supply circuit 1*b* and the power supply IC 10*b* may be examples of the power supply circuit 1 and the power supply IC 10 of FIG. 1A, respectively. In the power supply circuit 1*b*, the power supply IC 10*b* is provided with the input terminal 11, the output terminal 12, the FET 30, the voltage dividing resistors 31 and 32 while the output capacitor $C_o$ and the load LD are connected to the output terminal 12 similar to the power supply circuit 1*a* of FIG. 3. In the power supply circuit 1*b* and the following power supply circuits 1*c* and 1*d* in FIGS. 5 and 6, the connection features between the input terminal 11, the output terminal 12, the FET 30, the voltage dividing resistor 31, the voltage dividing resistor 32, the output capacitor $C_o$, the load LD and the ground are similar to those in the power supply circuit 1*a* of FIG. 3. Further, a voltage of a node between the voltage dividing resistors 31 and 32 is input as the feedback voltage $V_{fb}$. The power supply IC 10*b* also includes first and second voltage generating circuit transistors 41 and 42, a changeover switch 43, an error amplifier 44 and a switch control circuit 45. The error amplifier 44 may be an example of the error amplifier 23 of FIG. 1A.

The first voltage generating circuit (or a first reference voltage generating circuit) 41 generates and outputs a predetermined positive voltage (or a first reference voltage) $V_{1b}$ based on a voltage applied to the input terminal 11 (i.e., the input voltage $V_{in}$). If the input voltage $V_{in}$ is equal to or smaller than a predetermined first starting voltage, the first voltage generating circuit 41 may neither generate nor output the voltage $V_{1b}$ but, in the following description, it is assumed that the input voltage $V_{in}$ is high enough to activate the first voltage generating circuit 41 to generate the voltage $V_{1b}$.

The second voltage generating circuit (or a second reference voltage generating circuit) 42 generates and outputs a predetermined positive voltage (or a second reference voltage) $V_{2b}$ based on a voltage applied to the output terminal 12 (i.e., the output voltage $V_o$). If the output voltage $V_o$ is equal to or smaller than a predetermined second starting voltage, the second voltage generating circuit 42 may neither generate nor output the voltage $V_{2b}$ but, in the following description, it is assumed that the output voltage $V_o$ is high enough to activate the second voltage generating circuit 42 to generate the voltage $V_{2b}$. If the output voltage $V_o$ is equal to or smaller than the predetermined second starting voltage, the output voltage $V_o$ may be smaller than the threshold voltage $V_{th}$. On the other hand, if the second voltage generating circuit 42 outputs the voltage $V_{2b}$, the output voltage $V_o$ may be greater than the threshold voltage $V_{th}$.

The changeover switch 43 may select one of the first reference voltage $V_{1b}$ generated in the first voltage generating circuit 41 and the second reference voltage $V_{2b}$ generated in the second voltage generating circuit 42 and supply the selected voltage, as the reference voltage $V_{ref}$ to the error amplifier 44. That is, the changeover switch 43 selectively provides the voltage $V_{1b}$ or $V_{2b}$, as the reference voltage $V_{ref}$, for the error amplifier 44.

The error amplifier 44 has an inverted input terminal for receiving the reference voltage $V_{ref}$ via the changeover switch 43 and a non-inverted input terminal for receiving the feedback voltage $V_{fb}$. Further, the amplifier 44 may control the FET 30 based on the reference voltage $V_{ref}$ and the feedback voltage $V_{fb}$. The FET 30 may be controlled by varying the gate voltage of the FET 30 (i.e., a voltage potential of the gate of the FET 30).

The switch control circuit 45 controls the changeover switch 43 based on the output voltage $V_o$. For example, the switch control circuit 45 detects a voltage varied based on the output voltage $V_o$, determines whether the output voltage $V_o$ is smaller than the threshold voltage $V_{th}$ based on the detected voltage. Further, the switch control circuit 45 controls the changeover switch 43 such that the voltage $V_{1b}$ is selected as the reference voltage $V_{ref}$ if the output voltage $V_o$ is smaller than the threshold voltage $V_{th}$ and the voltage $V_{2b}$ is selected as the reference voltage $V_{ref}$ if the output voltage $V_o$ is equal to or greater than the threshold voltage $V_{th}$. In one embodiment, the voltage varied based on the output voltage $V_o$ may be the output voltage $V_o$ itself. In another embodiment as shown in FIG. 4, the switch control circuit 45 includes a voltage source 46 for generating a voltage of the threshold voltage $V_{th}$ and a comparator 47 for comparing the output voltage $V_o$ and the threshold voltage $V_{th}$ generated by the voltage source 46. The switch control circuit 45 operates with the input voltage $V_{in}$.

In the power supply circuit 1*b*, the voltage $V_{1b}$ is used as the reference voltage $V_{ref}$ during a time period in which the output voltage $V_o$ is smaller than the threshold voltage $V_{th}$, and the error amplifier 44 and the FET 30 are controlled based on the voltage $V_{1b}$. On the other hand, during a time period in which the output voltage $V_o$ is equal to or greater than the threshold voltage $V_{th}$, the voltage $V_{2b}$ is used as the reference voltage $V_{ref}$, and the error amplifier 44 and the FET 30 are controlled based on the voltage $V_{2b}$. With the above configurations, the characteristics of the power supply circuit described in the first embodiment may be improved.

The voltages $V_{1b}$ and $V_{2b}$ may be the same or may be different. When the voltage $V_{2b}$ is used as the reference voltage $V_{ref}$, the output voltage $V_o$ reaches and remains at the target voltage $V_{tg}$ in the steady state. The voltage $V_{1b}$ may be smaller than the voltage $V_{2b}$. When the voltage $V_{1b}$ is used as the reference voltage $V_{ref}$, the voltage $V_{1b}$ may be set so that the generating circuit 42 generates the voltage $V_{2b}$ having a specified value from the output voltage $V_o$.

Fourth Embodiment

Figure 5:
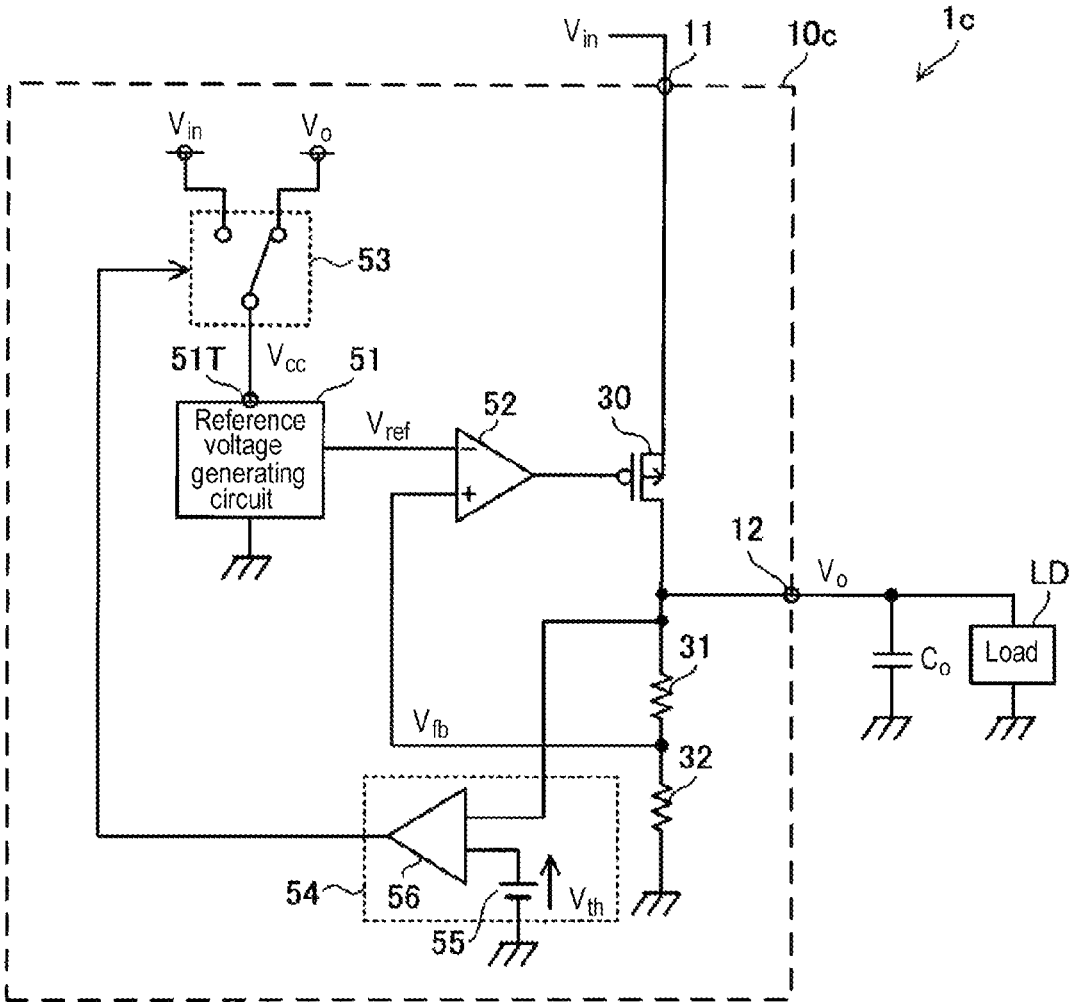
FIG. 5 depicts a configuration of a power supply circuit according to a fourth embodiment of the present disclosure.

A fourth embodiment of the present disclosure will now be described. FIG. 5 depicts a configuration of a power supply circuit 1*c* and a power supply IC 10*c* according to the fourth embodiment of the present disclosure. The power supply circuit 1*c* and the power supply IC 10*c* may be examples of the power supply circuit 1 and the power supply IC 10 of FIG. 1A, respectively. In the power supply circuit 1*c*, the power supply IC 10*c* is provided with the input terminal 11, the output terminal 12, the FET 30, the voltage dividing resistors 31 and 32 while the output capacitor $C_o$ and the load LD are connected to the output terminal 12 similar to the power supply circuit 1*a* of FIG. 3. The power supply IC 10*c* also includes a reference voltage generating circuit 51, an error amplifier 52, a changeover switch 53 and a switch control circuit 54. The error amplifier 52 may be an example of the error amplifier 23 of FIG. 1A.

The reference voltage generating circuit 51 having a feed terminal 51T may generate the reference voltage $V_{ref}$ based on a driving voltage $V_{cc}$ which is supplied to the feed terminal 51T. If the driving voltage $V_{cc}$ is equal to or smaller than a predetermined starting voltage, the reference voltage generating circuit 51 may neither generate nor output the reference voltage $V_{ref}$ but, in the following description, it is assumed that the driving voltage $V_{cc}$ is high enough to activate the reference voltage generating circuit 51 to generate the reference voltage $V_{ref}$.

The error amplifier 52 has an inverted input terminal for receiving the reference voltage $V_{ref}$ from the reference voltage generating circuit 51 and a non-inverted input terminal for receiving the feedback voltage $V_{fb}$. Further, the error amplifier 52 may control the FET 30 based on the reference voltage $V_{ref}$ and the feedback voltage $V_{fb}$. The FET 30 may be controlled by varying the gate voltage of the FET 30 (i.e., a voltage potential of the gate of the FET 30). As a difference voltage (i.e., $V_{ref}-V_{fb}$) becomes close to zero by the error amplifier 52, the output voltage $V_o$ reaches and remains at the target voltage $V_{tg}$ in the steady state.

The changeover switch 53, interposed between the input terminal 11, the output terminal 12 and the feed terminal 51T, may selectively supply the feed terminal 51T with the input voltage $V_{in}$ or the output voltage $V_o$ as the driving voltage $V_{cc}$.

The switch control circuit 54 controls the changeover switch 53 based on the output voltage $V_o$. That is, the switch control circuit 54 detects a voltage varied based on the output voltage $V_o$ and determines whether the output voltage $V_o$ is smaller than the threshold voltage $V_{th}$ based on the detected voltage. For example, the switch control circuit 54 controls the changeover switch 53 such that the input voltage $V_{in}$ is supplied, as the driving voltage $V_{cc}$, to the feed terminal 51T if the output voltage $V_o$ is smaller than the threshold voltage $V_{th}$. On the contrary, if the output voltage $V_o$ is equal to or greater than the threshold voltage $V_{th}$, the switch control circuit 54 controls the changeover switch 53 such that the output voltage $V_o$ is supplied, as the driving voltage $V_{cc}$, to the feed terminal 51T. In one embodiment, the voltage varied based on the output voltage $V_o$ may be the output voltage $V_o$ itself. In another embodiment as shown in FIG. 5, the switch control circuit 54 includes the voltage source 55 for generating a voltage of the threshold voltage $V_{th}$ and a comparator 56 for comparing the output voltage $V_o$ and the voltage $V_{th}$ generated by the voltage source 55. The switch control circuit 54 operates with the input voltage $V_{in}$.

In the power supply circuit 1*c*, the reference voltage $V_{ref}$ is generated from the input voltage $V_{in}$ during a time period in which the output voltage $V_o$ is smaller than the threshold voltage $V_{th}$ and the reference voltage $V_{ref}$ is generated from the output voltage $V_o$ during a time period in which the output voltage $V_o$ is equal to or greater than the threshold voltage $V_{th}$. With the above configurations, the characteristics of the power supply circuit described in the first embodiment may be improved.

Fifth Embodiment

Figure 6:
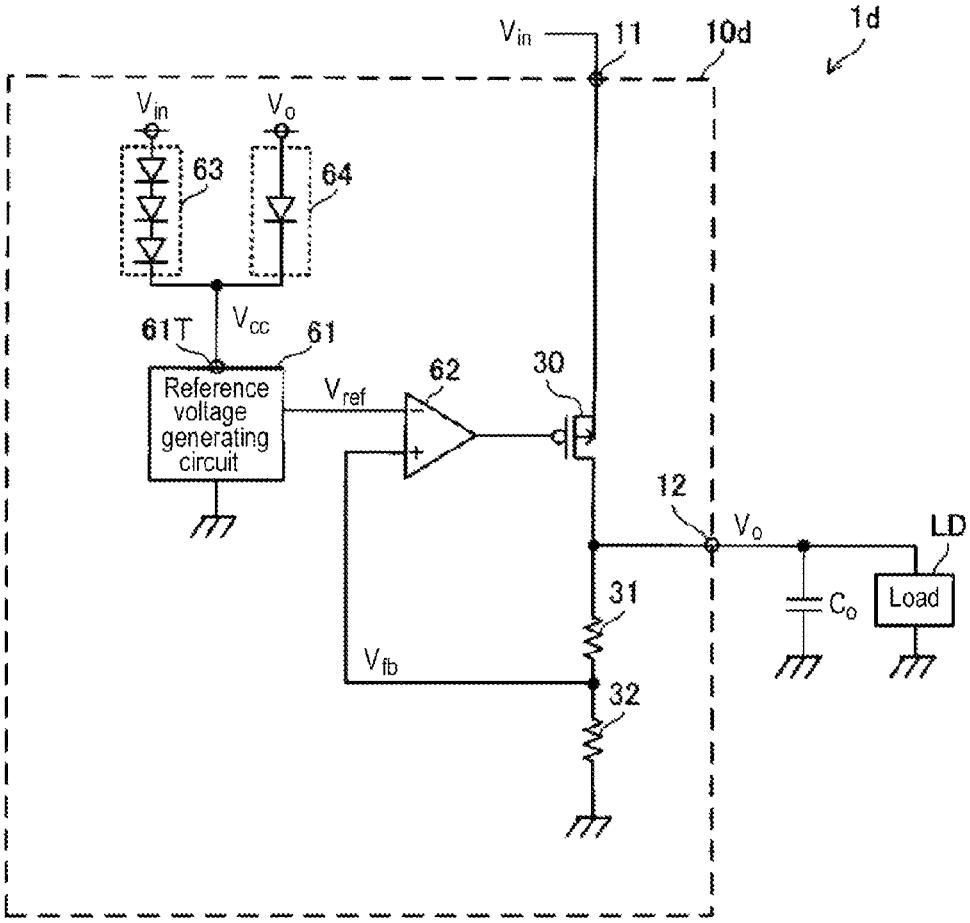
FIG. 6 illustrates a configuration of a power supply circuit according to a fifth embodiment of the present disclosure.

A fifth embodiment of the present disclosure will now be described. FIG. 6 illustrates a configuration of a power supply circuit 1*d* and a power supply IC 10*d* according to the fifth embodiment of the present disclosure. The power supply circuit 1*c* and the power supply IC 10*c* may be examples of the power supply circuit 1 and the power supply IC 10 of FIG. 1A, respectively. In the power supply circuit 1*d*, the power supply IC 10*d* is provided with the input terminal 11, the output terminal 12, the FET 30, the voltage dividing resistors 31 and 32 while the output capacitor $C_o$ and the load LD are connected to the output terminal 12 similar to the power supply circuit 1*a* of FIG. 3. The power supply IC 10*d* also includes a reference voltage generating circuit 61, an error amplifier 62, diode units 63 and 64. The error amplifier 62 may be an example of the error amplifier 23 of FIG. 1A.

The reference voltage generating circuit 61 having a feed terminal 61T may generate the reference voltage $V_{ref}$ based on a driving voltage $V_{cc}$ supplied to the feed terminal 61T. If the driving voltage $V_{cc}$ is equal to or smaller than a predetermined starting voltage, the reference voltage generating circuit 61 may neither generate nor output the reference voltage $V_{ref}$. However, in the following description, it is assumed that the driving voltage $V_{cc}$ is large enough to activate the reference voltage generating circuit 61 to generate the reference voltage $V_{ref}$.

The error amplifier 62 has an inverted input terminal for receiving the reference voltage $V_{ref}$ from the reference voltage generating circuit 61 and a non-inverted input terminal for receiving the feedback voltage $V_{fb}$. Further, the error amplifier 62 may control the FET 30 based on the reference voltage $V_{ref}$ and the feedback voltage $V_{fb}$. The FET 30 may be controlled by varying the gate voltage of the FET 30 (i.e., a voltage potential of the gate of the FET 30). As a difference voltage (i.e., $V_{ref}-V_{fb}$) becomes close to zero by the error amplifier 62, the output voltage $V_o$ reaches and remains at the target voltage $V_{tg}$ in the steady state.

The diode unit 63 includes m number of first diodes interposed between the feed terminal 61T and the input terminal 11 to which the input voltage $V_{in}$ is applied. Although three first diodes are illustrated in FIG. 6 (i.e., m=3), the number of the first diodes may be selected from any integer greater than one, two or more. If the number of the first diodes is equal to or greater than two (i.e., m≥2), the first diodes are connected in series and the series circuit of the first diodes is interposed between the input terminal 11 and the feed terminal 61T. Here, the forward bias direction of each of the first diodes is a direction from the input terminal 11 to the feed terminal 61T.

The diode unit 64 includes n number of second diodes interposed between the feed terminal 61T and the output terminal 12 to which the output voltage $V_o$ is applied. Although one second diode is illustrated in FIG. 6 (i.e., n=1), the number of the second diodes may also be selected from any integer greater than one, two or more. If one second diode is includes in the diode unit 64 (i.e., n=1), an anode and a cathode of the second diode are respectively connected to the output terminal 12 and the feed terminal 61T. If the number of the second diodes is equal to or greater than 2 (i.e., n≥2), the second diodes are connected in series and the series circuit of the second diodes is interposed between the output terminal 12 and the feed terminal 61T. Here, the forward bias direction of each of the second diodes is a direction from the output terminal 12 to the feed terminal 61T.

The power supply circuit 1*d* may have a first status where the output voltage $V_o$ is relatively small or a second status where the output voltage $V_o$ is relatively large. In the first status, a difference voltage ($V_{in}-V_{f63}$) is applied, as the driving voltage $V_{cc}$, from the input terminal 11 to the feed terminal 61T via the diode unit 63. On the other hand, in the second status, a difference voltage ($V_o-V_{f64}$) is applied, as the driving voltage $V_{cc}$, from the output terminal 12 to the feed terminal 61T via the diode unit 64. $V_{f63}$ represents a voltage drop in the diode unit 63 when the m number of first diodes are electrically conducted and $V_{f64}$ represents a voltage drop in the diode unit 64 when the n number of second diodes are electrically conducted.

Here, the voltages $V_{f63}$ and $V_{f64}$ are adjusted such that the voltage ($V_{in}-V_{f63}$) is greater than the voltage ($V_o-V_{f64}$) when the output voltage $V_o$ is smaller than the threshold voltage $V_{th}$. On the other hand, the voltages $V_{f63}$ and $V_{f64}$ are adjusted such that the voltage ($V_{in}-V_{f63}$) is smaller than the voltage ($V_o-V_{f64}$) when the output voltage $V_o$ is greater than the threshold voltage $V_{th}$. The voltages $V_{f63}$ and $V_{f64}$ may be varied when the values m and n are changed, respectively.

The voltage ($V_{in}-V_{f63}$) is supplied to the feed terminal 61T via the diode unit 63 when the output voltage $V_o$ is smaller than the threshold voltage $V_{th}$ and the voltage ($V_o-V_{f64}$) is supplied to the feed terminal 61T via the diode unit 64 when the output voltage $V_o$ is greater than the threshold voltage $V_{th}$. If the output voltage $V_o$ is equal to the threshold voltage $V_{th}$, a driving power is supplied from both of the input terminal 11 and the output terminal 12 to the reference voltage generating circuit 61 via the diode units 63 and 64 and the feed terminal 61T. The voltage drops $V_{f63}$ and $V_{f64}$ are varied to some extent depending on the magnitudes of currents flowing into the diode units 63 and 64, respectively. Even when the output voltage $V_o$ is smaller than or greater than the threshold voltage $V_{th}$, if the difference voltage ($V_o-V_{th}$) is small, the driving power may be supplied from both of the input terminal 11 and the output terminal 12 to the reference voltage generating circuit 61 via the diode units 63 and 64 and the feed terminal 61T.

Thus, In the power supply circuit 1*d*, the reference voltage $V_{ref}$ is generated from the input voltage $V_{in}$ during the time period where the output voltage $V_o$ is smaller than the threshold voltage $V_{th}$ and the reference voltage $V_{ref}$ is generated from the output voltage $V_o$ during the time period where the output voltage $V_o$ is greater than the threshold voltage $V_{th}$. With the above configurations, the characteristics of the power supply circuit described in the first embodiment may be improved.

In addition, as the power supply circuit 1*d* of FIG. 6 is a series regulator, the number m is set to two or more and be greater than the number n (accordingly, $V_{f63}>V_{f64}$). However, as will be described later, if the diode units 63 and 64 are provided to a step-up switching regulator, the number m may be 1 and equal to or smaller than the number n. When the number m is set to 1, an anode and a cathode of one first diode may be connected to the input terminal 11 and the feed terminal 61T, respectively.

Here, the circuits shown in FIGS. 3 to 6 will be compared below in terms of configuration. Although any configurations of FIGS. 3 to 6 may improve the characteristics of the power supply circuit, the configuration of FIG. 5 may allow a reverse current flowing through the changeover switch 53 and the configuration of FIG. 6 may cause voltage drops in the diode units 63 and 64. The voltage drops in the diode units may increase the minimal input voltage $V_{in}$ or output voltage $V_o$ which is required to generate the reference voltage $V_{ref}$, and in turn, increase power consumption. Therefore, such voltage drops may need to be avoided. The configuration of FIG. 4 may prevent such reverse current or voltage drops.

In addition, when the changeover switches 43 and 53 shown in FIGS. 4 and 5 are used, abnormality may occur in the operation of the power supply circuit during the switch changeover. In contrast, in the configuration of FIG. 3, the abnormal operation of the power supply circuit may not occur since such switch changeover is not performed. In addition, the configuration of FIG. 3 may cause no voltage drop in the diode units.

Sixth Embodiment

Figure 7:
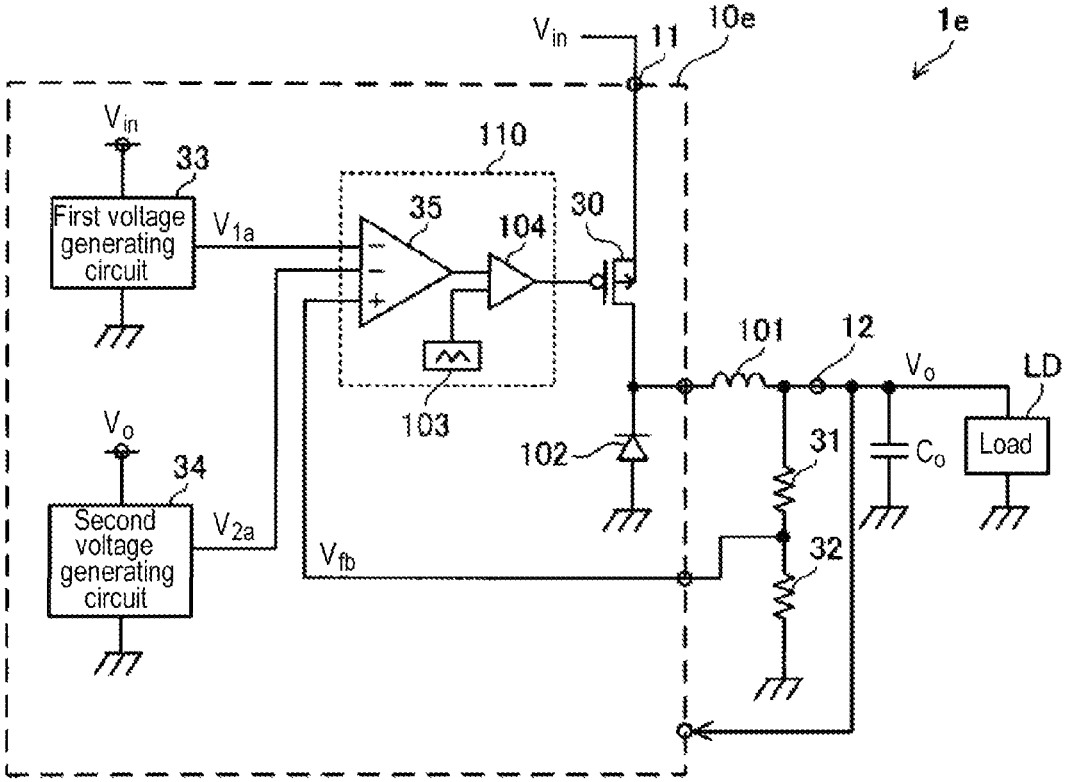
FIG. 7 shows a configuration of one example of a power supply circuit according to a sixth embodiment of the present disclosure.

A sixth embodiment of the present disclosure will now be described. Although the power supply circuit 1 of FIG. 1A was assumed to be used in a series regulator and the power supply circuits 1*a* to 1*d* have been described as examples thereof, the power supply circuit 1 may also be used in a switching regulator. FIG. 7 shows a configuration of a power supply circuit 1*e* for use in a switching regulator. The power supply circuit 1*e* includes a power supply IC 10*e*, an inductor 101, the voltage dividing resistors 31 and 32, and the output capacitor $C_o$. The power supply circuit 1*e* and the power supply IC 10*e* may be examples of the power supply circuit 1 and the power supply IC 10 of FIG. 1A, respectively. An output transistor in the switching regulator generates the output voltage $V_o$ via the output terminal 12 by switching the input voltage $V_{in}$ (specifically, by alternately forming or blocking a current flow path including the input terminal 11 and the output transistor by turning-ON/OFF of the output transistor).

The power supply IC 10*e* includes the FET 30, the generating circuits 33 and 34 and the error amplifier 35 as in the power supply IC 10*a* of FIG. 3. The configurations of the generating circuits 33 and 34, and the error amplifier 35, and connection features thereof are similar to those described above.

In the power supply circuit 1*e*, the voltage dividing resistors 31 and 32, and the output terminal 12 are disposed outside the power supply IC 10*e*. A source of the FET 30 is connected to the input terminal 11 and a source of the FET 30 is connected to both of a cathode of a diode 102 and one end of the inductor 101. An anode of the diode 102 is connected to the ground. The other end of the inductor 101 is connected to the ground via a series circuit of the voltage dividing resistors 31 and 32 and also via the output capacitor $C_o$. A node between the inductor 101, the series circuit of the voltage dividing resistors 31 and 32 and the output capacitor $C_o$ is used as the output terminal 12. A voltage of a node between the voltage dividing resistors 31 and 32 is supplied, as a feedback voltage $V_{fb}$, to a non-inverted input terminal of the error amplifier 35. Although it is shown in the example of FIG. 7 that the FET 30 and the diode 102 are mounted on the power supply IC 10*e*, at least one of the FET 30 and the diode 102 may be installed outside the power supply IC 10*e*.

The power supply IC 10*e* includes a control circuit 110 having the error amplifier 35, a triangular wave generating circuit 103 and a comparator 104. In the comparator 104, an output signal of the error amplifier 35 is compared with a triangular wave generated and output by the triangular wave generating circuit 103. Based on a result of the comparison, the control circuit 110 may switch the FET 30. Due to the switching of the FET 30, the input voltage $V_{in}$ is modulated by means of pulse width modulation and a DC output voltage $V_o$ may be applied on the output terminal 12. Since the control circuit 110 switches the FET 30 based on the reference voltage $V_{ref}$ and the feedback voltage $V_{fb}$, the output voltage $V_o$ reaches and remains at the target voltage $V_{tg}$ in the steady state.

In the power supply circuit 1*e*, as in the power supply circuit 1*a* used as a series regulator, the reference voltage $V_{ref}$ is generated from the output voltage $V_o$ in the steady state. Accordingly, the variation of the reference voltage $V_{ref}$ due to the variation of the input voltage $V_{in}$ in the steady state may be eliminated which results in improving characteristics such as line regulation of the power supply circuit 1*e*. Since an output voltage of the switching regulator has relatively many superimposed ripples, improvement of PSSR due to the generation of the reference voltage $V_{ref}$ from the output voltage $V_o$ may not be high compared to that in the series regulator.

Figure 8:
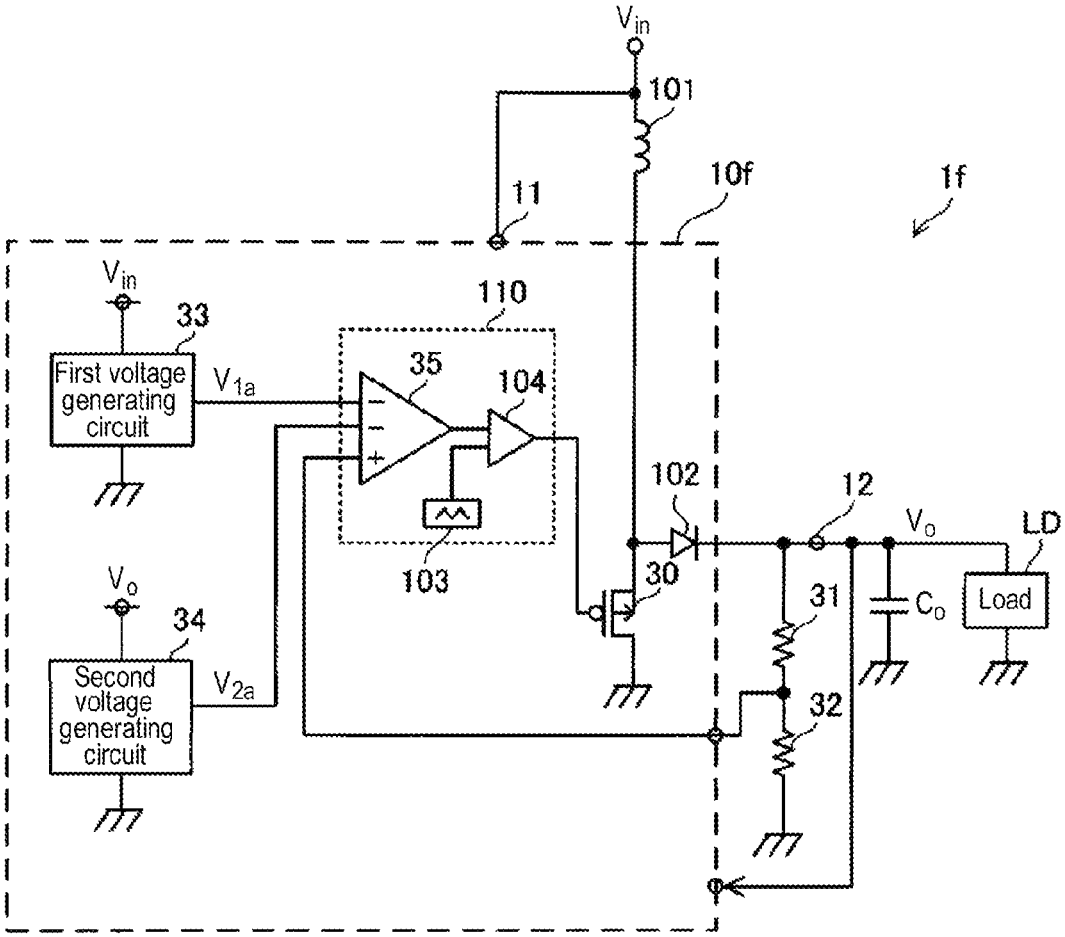
FIG. 8 depicts a configuration of another example of a power supply circuit according to the sixth embodiment of the present disclosure.

Although FIG. 7 shows a step-down switching regulator as an example of the power supply circuit 1*e*, the power supply circuit 1*e* may be used as a step-up switching regulator. That is, the power supply circuit 1 may be used in either the step-down or step-up switching regulator. FIG. 8 depicts a configuration of a power supply circuit 1*f* which is an exemplary modification of the power supply circuit 1*e*. The power supply circuit 1*f* and a power supply IC 10*f* thereof have similar units and elements as the power supply circuit 1*e* and the power supply IC 10*e* of FIG. 7. In the power supply circuit 1*f*, however, one end of the inductor 101 is connected to the input terminal 11, the other end of the inductor 101 is connected to both of a source of the FET 30 and an anode of the diode 102, a drain of the FET 30 is connected to the ground, a cathode of the diode 102 is connected to the ground via a series circuit of the voltage dividing resistors 31 and 32 and also via the output capacitor $C_o$, and a node between the cathode of the diode 102, the series circuit of the voltage dividing resistors 31 and 32 and the output capacitor $C_o$ is used as the output terminal 12.

In addition, although the examples of applying the features of the second embodiment corresponding to FIG. 3 to the switching regulator have been illustrated in FIGS. 7 and 8, the features of the third, fourth and fifth embodiments corresponding respectively to FIGS. 4, 5 and 6 may also be applied to the switching regulator as the power supply circuit 1. In addition, the specified circuit configuration of the switching regulator is not limited to those shown in FIGS. 7 and 8 and the features of the first to fifth embodiments can be applied to all power supply circuits classified as the switching regulator.

Seventh Embodiment

A seventh embodiment of the present disclosure will now be described. The seventh embodiment describes exemplary modifications of the power supply circuits 1*a* to 1*f* of FIGS. 3 to 8. Although the FET 30 in the above description is a P-channel MOSFET, the FET 30 may be replaced with an N-channel MOSFET in the power supply circuits 1*a* to 1*f*.

The source and the drain of the FET 30 in the P-channel MOSFET are respectively changed to a drain and a source of the FET 30 when it is the N-channel MOSFET. In addition, when the FET 30 is the N-channel MOSFET, the inverted input terminals and the non-inverted input terminals of the error amplifiers 35, 44, 52 and 62 may be reversed relative to those described above.

In addition, the FET 30 may be formed as a JFET (Junction Field-Effect Transistor). In addition, the P or N-channel FET 30 may be replaced with a PNP type or NPN type bipolar transistor. When the FET 30 is replaced with the bipolar transistor, the gate, drain and source described above may be respectively replaced with a base, a collector and an emitter, and the gate voltage may be replaced with a base voltage.

Eighth Embodiment

An eighth embodiment of the present disclosure will now be described. In the following description, the power supply circuit 1 refers to any one of the above-described power supply circuits including the power supply circuits 1*a* to 1*f* and the power supply IC 10 refers to any one of the above-described power supply ICs including the power supply ICs 10*a* to 10*f*.

Figure 9:
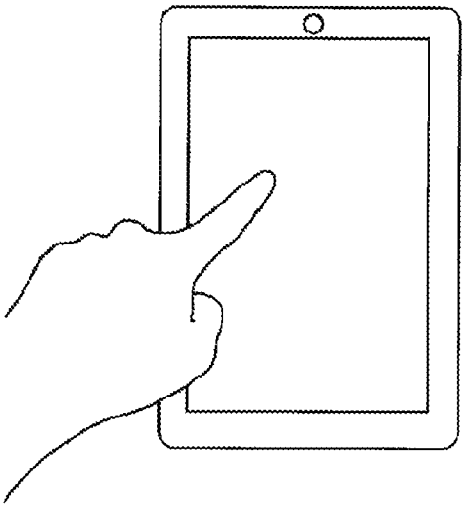
FIG. 9 is an external view of a smartphone according to an eighth embodiment of the present disclosure.
Figure 10:
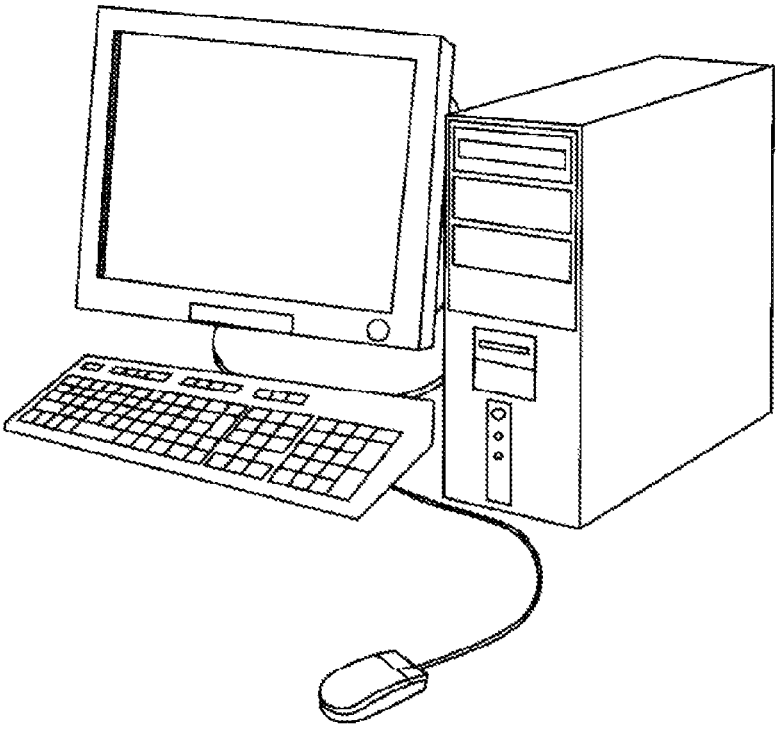
FIG. 10 is an external view of a personal computer according to the eighth embodiment of the present disclosure.
Figure 11:
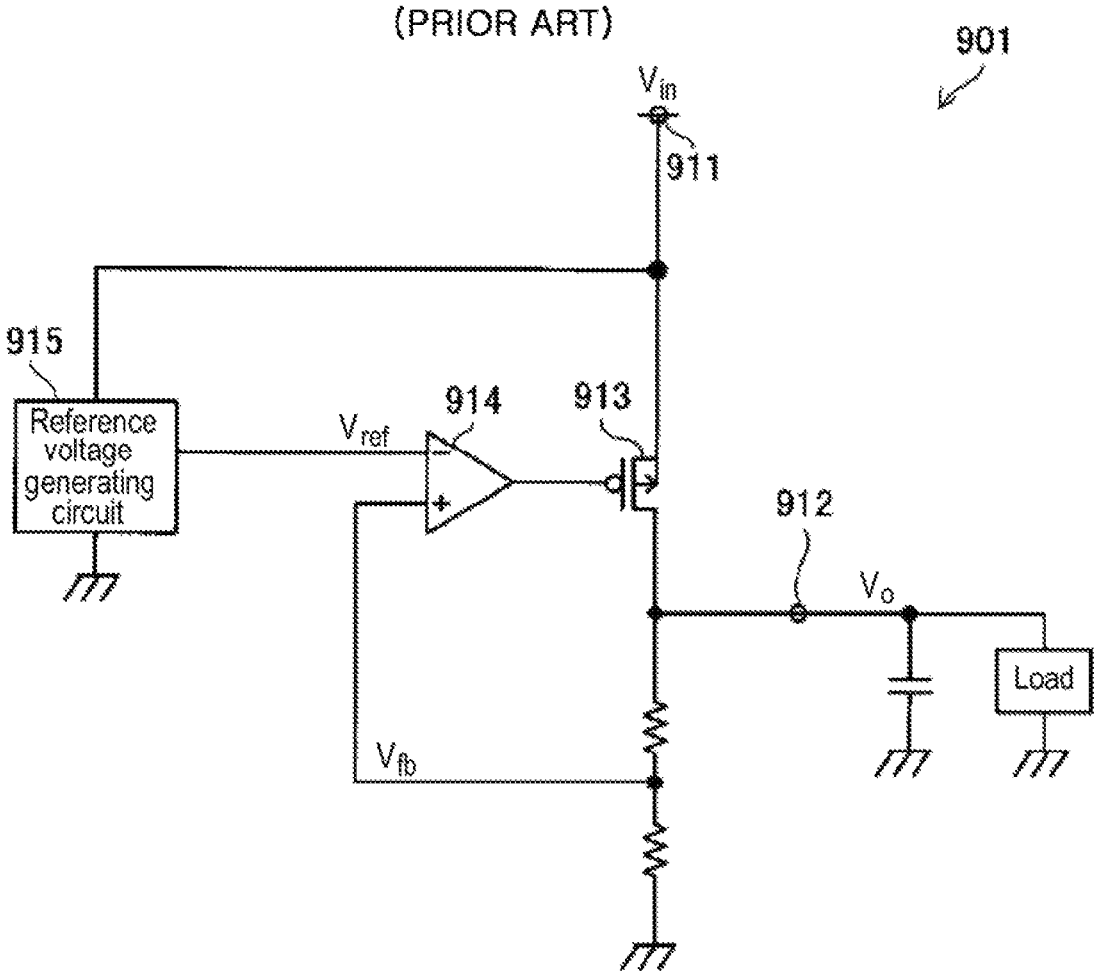
FIG. 11 (PRIOR ART)
FIG. 11 shows a circuit diagram of a power supply circuit in the related art.
Figure 12:
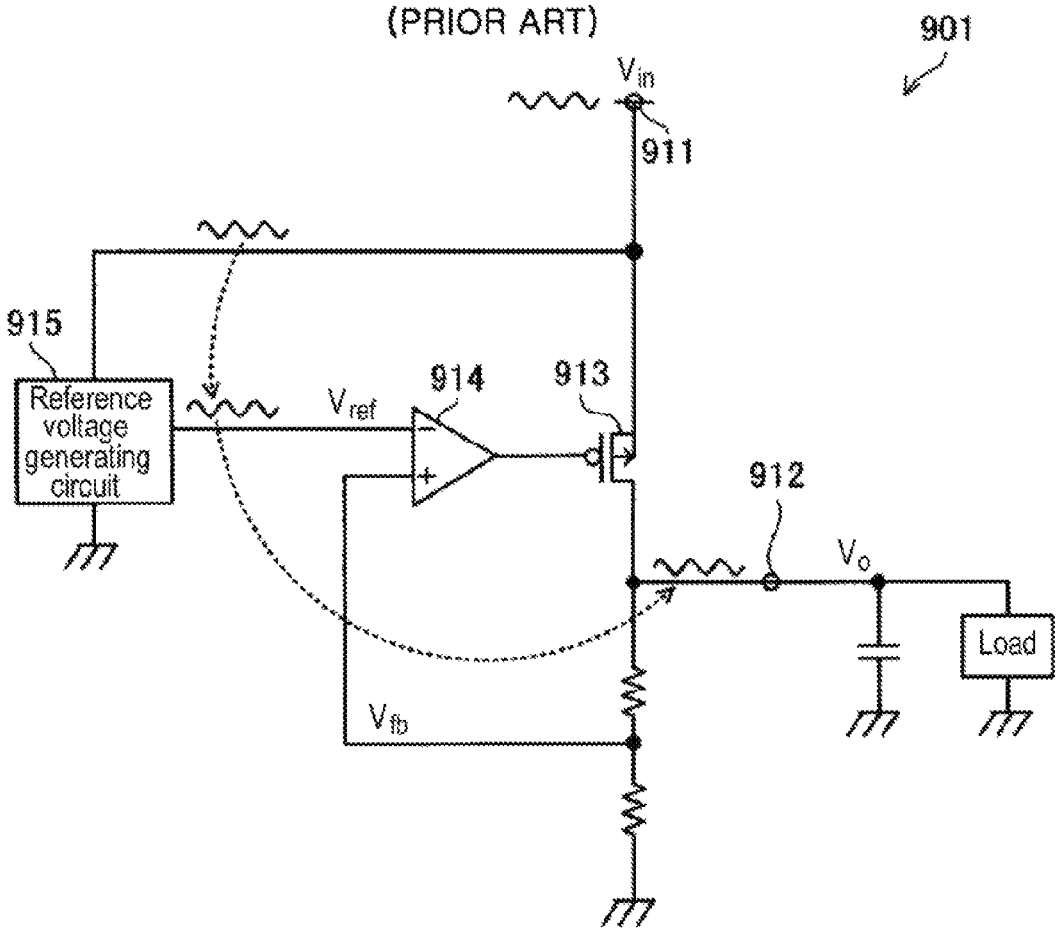
FIG. 12 (PRIOR ART)
FIG. 12 illustrates changes in input, reference, and output voltages of the power supply circuit in the related art.

The power supply circuit 1 and the power supply IC 10 may be equipped in any electronic apparatuses. In this case, all or some of electric parts of the electronic apparatuses may be driven with the output voltage $V_o$. The electronic apparatuses include any apparatuses capable of acquiring, reproducing and processing any information, such as a mobile phone, PDA, personal computer, audio device, display panel, magnetic disk device (magnetic disk storage), optical disk device (for example, a data storing/reproducing device using DVD (Digital Versatile Disc) or BD (Blu-ray® Disc), electronic book reader, electronic dictionary, digital camera, game machine, navigator and so on. The mobile phone may be one that is classified as a so-called smartphone. Examples of the electronic apparatuses equipped with the power supply circuit 1 may include a smartphone shown in FIG. 9 and a personal computer shown in FIG. 10. The personal computer may be of a notebook type.

MODIFICATIONS

The embodiments of the present disclosure can be appropriately modified in different ways within the scope of technical idea defined in the claims. The above embodiments are only illustrative and the meanings of the terms of elements in the present disclosure are not intended to be limited to those described in the above embodiments. The specific numeral values shown in the above description are only examples and, as a matter of course, may be changed to any other values. As notes applicable to the above embodiments, Note 1 and Note 2 are described below. Contents of these notes may be combined in any ways, unless inconsistent.

[Note 1]

The configuration of the power supply circuit 1 may be modified such that the input voltage $V_{in}$ and the output voltage $V_o$ are negative.

[Note 2]

The power supply IC 10 is a semiconductor device including an integrated circuit used to form the power supply circuit 1. The electronic apparatus described in the eighth embodiment includes the semiconductor device. Circuits other than the circuit used to form the power supply circuit 1 may be further incorporated in the power supply IC 10. The power supply IC 10 may contain circuit elements used to form a plurality of power supply circuits 1 and a switching regulator and a series regulator may be mixed in the plurality of power supply circuits. The input terminal 11 may not be a terminal positioned at an interface between the power supply IC 10 and the outside of the power supply IC 10 and may be positioned in a metal portion existing in the inside or outside of the power supply IC 10. This may be equally applied to the output terminal 12. Any loads LD (such as integrated processing units or the like) driven using the output voltage $V_o$ may be contained in the power supply IC 10.

The present disclosure can be applied to any power supply circuit including an error amplifier configured to control an output transistor based on a result of comparison between a reference voltage and a feedback voltage according to an output voltage. As long as the output transistor can be controlled based on the result of the comparison, other circuit elements (for example, the comparator 104 in the example of FIG. 7) may be interposed between the error amplifier and the output transistor.

In some embodiments according to the present disclosure, it is possible to provide a power supply circuit which is capable of contributing to improving characteristics.

While certain embodiments have been described, these embodiments have been presented by way of example only, and are not intended to limit the scope of the present disclosure. Indeed, the novel methods and apparatuses described herein may be embodied in a variety of other forms; furthermore, various omissions, substitutions, and changes in the form of the embodiments described herein may be made without departing from the spirit of the present disclosure. The accompanying claims and their equivalents are intended to cover such forms or modifications as would fall within the scope and spirit of the present disclosure.

What is claimed is:

1. A power supply circuit comprising:

a transistor disposed between an input terminal to which an input voltage is applied and an output terminal to which an output voltage is applied;

an error amplifier configured to compare a feedback voltage, varied based on the output voltage, and a reference voltage, and control the transistor based on a result of the comparison, a first voltage generating circuit configured to generate a first voltage based on the input voltage; and a second voltage generating circuit configured to generate a second voltage based on the output voltage;

wherein the reference voltage is selected as the first voltage generated by the first voltage generation circuit based on the input voltage or the second voltage generated by the second voltage generating circuit based on the output voltage.

2. The power supply circuit of claim 1, wherein the reference voltage is selected as the first voltage generated by the first voltage generating circuit based on the input voltage if the output voltage is smaller than a predetermined value, and wherein the reference voltage is selected as the second voltage generated by the second voltage generating circuit based on the output voltage if the output voltage is greater than the predetermined value.

3. The power supply circuit of claim 2, further comprising:

a changeover switch configured to selectively provide the error amplifier with the first voltage generated by the first voltage generation circuit based on the input voltage or the second voltage generated by the second voltage generating circuit based on the output voltage as the reference voltage; and a switch control circuit configured to control the changeover switch based on the output voltage.

4. The power supply circuit of claim 1, wherein the power supply circuit is configured as a series regulator.

5. The power supply circuit of claim 1, wherein the power supply circuit is configured as a switching regulator.

6. A semiconductor device comprising an integrated circuit for configuring the power supply circuit of claim 1.

7. An electronic apparatus comprising the semiconductor device of claim 6.

8. A power supply circuit comprising:

a transistor disposed between an input terminal to which an input voltage is applied and an output terminal to which an output voltage is applied;

an error amplifier configured to compare a feedback voltage varied based on the output voltage and a reference voltage, and control the transistor based on a result of the comparison, the reference voltage being generated by selectively using the input voltage or the output voltage;

a first voltage generating circuit configured to generate and output a first voltage based on the input voltage; and a second voltage generating circuit configured to generate and output a second voltage based on the output voltage if the output voltage is greater than the predetermined value, the second voltage being greater than the first voltage, wherein the reference voltage is generated based on the input voltage if the output voltage is smaller than a predetermined value, wherein the reference voltage is generated based on the output voltage if the output voltage is greater than the predetermined value, and wherein the error amplifier is configured to include first and second input terminals for receiving the first and second voltages, respectively, and control the transistor using a greater voltage of the received first and second voltages as the reference voltage.

9. A power supply circuit comprising:

a transistor disposed between an input terminal to which an input voltage is applied and an output terminal to which an output voltage is applied;

an error amplifier configured to compare a feedback voltage varied based on the output voltage and a reference voltage, and control the transistor based on a result of the comparison, the reference voltage being generated by selectively using the input voltage or the output voltage;

a reference voltage generating circuit configured to generate the reference voltage based on a voltage applied to a feed terminal;

a first diode unit, which is interposed between the input terminal and the feed terminal, configured to include one or more first diodes, a forward bias direction of each of the one or more first diodes being a direction from the input terminal to the feed terminal; and a second diode unit, which is interposed between the output terminal and the feed terminal, configured to include one or more second diodes, a forward bias direction of each of the one or more second diodes being a direction from the output terminal to the feed terminal, wherein the reference voltage is generated based on the input voltage if the output voltage is smaller than a predetermined value, wherein the reference voltage is generated based on the output voltage if the output voltage is greater than the predetermined value, and wherein a voltage associated with the input voltage via the first diode unit or a voltage associated with the output voltage via the second diode unit is supplied to the feed terminal based on the output voltage.

10. A power supply circuit comprising:

an input terminal to which an input voltage is applied;

an output terminal to which an output voltage is applied;

an output transistor configured to generate the output voltage via the output terminal by switching the input voltage;

an error amplifier configured to compare a feedback voltage varied based on the output voltage and a reference voltage, and control the output transistor based on a result of the comparison, a first voltage generating circuit configured to generate a first voltage based on the input voltage; and a second voltage generating circuit configured to generate a second voltage based on the output voltage;

wherein the reference voltage is selected as the first voltage generated by the first voltage generation circuit based on the input voltage or the second voltage generated by the second voltage generating circuit based on the output voltage.

11. The power supply circuit of claim 10, wherein the reference voltage is selected as the first voltage generated by the first voltage generating circuit based on the input voltage if the output voltage is smaller than a predetermined value, and wherein the reference voltage is selected as the second voltage generated by the second voltage generating circuit based on the output voltage if the output voltage is greater than the predetermined value.

12. The power supply circuit of claim 11, further comprising:

a changeover switch configured to selectively provide the error amplifier with the first voltage generated by the first voltage generation circuit based on the input voltage or the second voltage generated by the second voltage generating circuit based on the output voltage as the reference voltage; and a switch control circuit configured to control the changeover switch based on the output voltage.

13. The power supply circuit of claim 10, wherein the power supply circuit is configured as a switching regulator.

14. A semiconductor device comprising an integrated circuit for configuring the power supply circuit of claim 10.

15. An electronic apparatus comprising the semiconductor device of claim 14.

16. A power supply circuit comprising:

an input terminal to which an input voltage is applied;

an output terminal to which an output voltage is applied;

an output transistor configured to generate the output voltage via the output terminal by switching the input voltage;

an error amplifier configured to compare a feedback voltage varied based on the output voltage and a reference voltage, and control the transistor based on a result of the comparison, the reference voltage being generated by selectively using the input voltage or the output voltage;

a first voltage generating circuit configured to generate and output a first voltage based on the input voltage; and a second voltage generating circuit configured to generate and output a second voltage based on the output voltage if the output voltage is greater than the predetermined value, the second voltage being greater than the first voltage, wherein the reference voltage is generated based on the input voltage if the output voltage is smaller than a predetermined value, wherein the reference voltage is generated based on the output voltage if the output voltage is greater than the predetermined value, and wherein the error amplifier is configured to include first and second input terminals for receiving the first and second voltages, respectively, and control the output transistor using a greater voltage of the received first and second voltages as the reference voltage.

17. A power supply circuit comprising:

an input terminal to which an input voltage is applied;

an output terminal to which an output voltage is applied;

an output transistor configured to generate the output voltage via the output terminal by switching the input voltage;

an error amplifier configured to compare a feedback voltage varied based on the output voltage and a reference voltage, and control the transistor based on a result of the comparison, the reference voltage being generated by selectively using the input voltage or the output voltage;

a reference voltage generating circuit configured to generate the reference voltage based on a voltage applied to a feed terminal;

a first diode unit, which is interposed between the input terminal and the feed terminal, configured to include one or more first diodes, a forward bias direction of each of the one or more first diodes being a direction from the input terminal to the feed terminal; and a second diode unit, which is interposed between the output terminal and the feed terminal, configured to include one or more second diodes, a forward bias direction of each of the one or more second diodes being a direction from the output terminal to the feed terminal, wherein the reference voltage is generated based on the input voltage if the output voltage is smaller than a predetermined value, wherein the reference voltage is generated based on the output voltage if the output voltage is greater than the predetermined value, and wherein a voltage associated with the input voltage via the first diode unit or a voltage associated with the output voltage via the second diode unit is supplied to the feed terminal based on the output voltage.

* * * * *